US006827821B2

(12) United States Patent
Brewster et al.

(10) Patent No.: US 6,827,821 B2
(45) Date of Patent: Dec. 7, 2004

(54) HIGH PERMEABILITY, MULTI-LAYER WOVEN MEMBERS EMPLOYING MACHINE DIRECTION BINDER YARNS FOR USE IN PAPERMAKING MACHINE

(75) Inventors: James Loy Brewster, Waskom, TX (US); John M. Thomas, Shreveport, LA (US); Jeffrey Bruce Herman, Bala Cynwyd, PA (US); Stewart Lister Hay, Ramsbottom Bury (GB)

(73) Assignee: Voith Fabrics Heidenheim GmbH & Co. KG, Heidenheim (DE)

( * ) Notice: Subject to any disclaimer, the term of this patent is extended or adjusted under 35 U.S.C. 154(b) by 44 days.

(21) Appl. No.: 10/307,788

(22) Filed: Dec. 2, 2002

(65) Prior Publication Data

US 2004/0104005 A1 Jun. 3, 2004

(51) Int. Cl.[7] ..... D21F 1/10; D21F 7/12; D03D 13/00; B32B 5/02

(52) U.S. Cl. ..... 162/358.2; 162/348; 162/900; 162/902; 162/903; 139/383 A; 139/425 A; 442/206; 442/207; 428/147; 428/175; 428/196

(58) Field of Search ..... 162/199, 116, 162/117, 306, 348, 358.2, 900–904, 362; 139/383 A, 425 A; 428/175, 196, 102, 141, 147, 193; 442/203–207, 268, 270; 28/110, 142; 34/114–125

(56) References Cited

U.S. PATENT DOCUMENTS

| | | | | |
|---|---|---|---|---|
| 2,180,054 A | * | 11/1939 | Hindle et al. | 139/408 |
| 3,143,150 A | * | 8/1964 | Buchanan | 139/425 A |
| 4,314,589 A | | 2/1982 | Buchanan et al. | |
| 4,501,303 A | | 2/1985 | Osterberg | |
| 4,514,345 A | | 4/1985 | Johnson et al. | |
| 4,528,239 A | | 7/1985 | Trokhan | |
| 4,529,480 A | | 7/1985 | Trokhan | |
| 4,592,396 A | * | 6/1986 | Borel et al. | 139/425 A |
| 4,636,426 A | * | 1/1987 | Fleischer | 442/149 |
| 4,705,601 A | | 11/1987 | Chiu | |
| 4,729,412 A | | 3/1988 | Bugge | |
| 4,821,780 A | | 4/1989 | Tate | |
| 4,832,090 A | | 5/1989 | Krenkel et al. | |
| 4,921,750 A | | 5/1990 | Todd | |
| 4,934,414 A | * | 6/1990 | Borel | 139/383 A |
| 4,941,514 A | | 7/1990 | Taipale | |
| 4,945,952 A | | 8/1990 | Vohringer | |
| 4,967,805 A | * | 11/1990 | Chiu et al. | 139/383 A |
| 4,995,429 A | * | 2/1991 | Kositzke | 139/383 R |

(List continued on next page.)

FOREIGN PATENT DOCUMENTS

| | | |
|---|---|---|
| WO | WO 89/09848 | 10/1989 |
| WO | WO 91/14813 | 10/1991 |

*Primary Examiner*—Steven P. Griffin
*Assistant Examiner*—Eric Hug
(74) *Attorney, Agent, or Firm*—Caesar, Rivise, Bernstein, Cohen & Pokotilow, Ltd.

(57) ABSTRACT

A multilayer, woven fabric for use in a papermaking machine includes a self-sustaining top layer including a plurality of top machine direction yarns interwoven with a plurality of top cross-machine-direction yarns and a bottom layer including a plurality of bottom pairs of machine direction yarns interwoven with a plurality of bottom cross-machine-direction yarns. Each of the bottom cross-machine-direction yarns substantially vertically underlies a respective top cross-machine-direction yarn and each of the bottom pairs of machine direction yarns substantially vertically underlies a respective top machine direction yarn, with at least one of the machine direction yarns in at least some of the bottom pairs of machine direction yarns interweaving the bottom cross-machine-direction yarns to each other and to the top cross-machine-direction yarns of the top layer.

32 Claims, 10 Drawing Sheets

U.S. PATENT DOCUMENTS 5,054,525 A 10/1991 Vohringer
5,074,339 A 12/1991 Vohringer
5,092,372 A 3/1992 Fitzka et al.
5,101,866 A 4/1992 Quigley
5,114,777 A 5/1992 Gaisser
5,151,316 A 9/1992 Durkin et al.
5,152,326 A 10/1992 Vohringer
5,334,289 A * 8/1994 Trokhan et al. ..... 162/358.2
5,454,405 A 10/1995 Hawes
5,496,624 A 3/1996 Stelljes, Jr. et al.
5,799,708 A * 9/1998 Josef ..... 139/383 A
5,840,411 A 11/1998 Stelljes, Jr. et al.
5,944,062 A * 8/1999 Gampe ..... 139/383 A
5,954,097 A * 9/1999 Boutilier ..... 139/383 A
6,110,324 A * 8/2000 Trokhan et al. ..... 162/358.2
6,123,116 A * 9/2000 Ward et al. ..... 139/383 A
6,358,594 B1 * 3/2002 Ampulski ..... 428/102
6,745,797 B2 * 6/2004 Troughton ..... 139/383 A

* cited by examiner

| | 1 | 2 | 3 | 4 | 5 | 6 | 7 | 8 | 9 | 10 | 11 | 12 | | | |
|---|---|---|---|---|---|---|---|---|---|---|---|---|---|---|---|
| STEPS | | | | | FRAMES | | | | | | | | | | |
| 1 | | 2 | | 4 | 5 | 6 | 7 | 8 | 9 | 10 | 11 | 12 | | | BOT |
| 2 | | 2 | | | | | | 8 | | | | | | | TOP |
| 3 | 1 | 2 | 3 | | 5 | | 7 | 8 | 9 | 10 | 11 | 12 | | | BOT |
| 4 | | | | | 5 | | | | | | 11 | | | | TOP |
| 5 | 1 | 2 | 3 | 4 | 5 | 6 | | 8 | | 10 | 11 | 12 | | | BOT |
| 6 | | 2 | 3 | | | | | 8 | | | | | | | TOP BI |
| 7 | 1 | 2 | 3 | 4 | 5 | 6 | 7 | 8 | 9 | | 11 | | | | BOT |
| 8 | | | | | 5 | | | | | | 11 | | | | TOP |
| 9 | | 2 | | 4 | 5 | 6 | 7 | 8 | 9 | 10 | 11 | 12 | | | BOT |
| 10 | | 2 | | | | | | 8 | | | | | | | TOP |
| 11 | 1 | 2 | 3 | | 5 | | 7 | 8 | 9 | 10 | 11 | 12 | | | BOT |
| 12 | | | | | 5 | | | | | 10 | 11 | | | | TOP BI |
| 13 | 1 | 2 | 3 | 4 | 5 | 6 | | 8 | | 10 | 11 | 12 | | | BOT |
| 14 | | 2 | | | | | | 8 | | | | | | | TOP |
| 15 | 1 | 2 | 3 | 4 | 5 | 6 | 7 | 8 | 9 | | 11 | | | | BOT |
| 16 | | | | | 5 | | | | | | 11 | | | | TOP |
| 17 | | 2 | | 4 | 5 | 6 | 7 | 8 | 9 | 10 | 11 | 12 | | | BOT |
| 18 | | 2 | | | | | 7 | 8 | | | | | | | TOP BI |
| 19 | 1 | 2 | 3 | | 5 | | 7 | 8 | 9 | 10 | 11 | 12 | | | BOT |
| 20 | | | | | 5 | | | | | | 11 | | | | TOP |
| 21 | 1 | 2 | 3 | 4 | 5 | 6 | | 8 | | 10 | 11 | 12 | | | BOT |
| 22 | | 2 | | | | | | 8 | | | | | | | TOP |
| 23 | 1 | 2 | 3 | 4 | 5 | 6 | 7 | 8 | 9 | | 11 | | | | BOT |
| 24 | | | | 4 | 5 | | | | | | 11 | | | | TOP BI |
| 25 | | 2 | | 4 | 5 | 6 | 7 | 8 | 9 | 10 | 11 | 12 | | | BOT |
| 26 | | 2 | | | | | | 8 | | | | | | | TOP |
| 27 | 1 | 2 | 3 | | 5 | | 7 | 8 | 9 | 10 | 11 | 12 | | | BOT |
| 28 | | | | | 5 | | | | | | 11 | | | | TOP |
| 29 | 1 | 2 | 3 | 4 | 5 | 6 | | 8 | | 10 | 11 | 12 | | | BOT |
| 30 | 1 | 2 | | | | | | 8 | | | | | | | TOP BI |
| 31 | 1 | 2 | 3 | 4 | 5 | 6 | 7 | 8 | 9 | | 11 | | | | BOT |
| 32 | | | | | 5 | | | | | | 11 | | | | TOP |
| 33 | | 2 | | 4 | 5 | 6 | 7 | 8 | 9 | 10 | 11 | 12 | | | BOT |
| 34 | | 2 | | | | | | 8 | | | | | | | TOP |
| 35 | 1 | 2 | 3 | | 5 | | 7 | 8 | 9 | 10 | 11 | 12 | | | BOT |
| 36 | | | | | 5 | | | | | | 11 | 12 | | | TOP BI |
| 37 | 1 | 2 | 3 | 4 | 5 | 6 | | 8 | | 10 | 11 | 12 | | | BOT |
| 38 | | 2 | | | | | | 8 | | | | | | | TOP |
| 39 | 1 | 2 | 3 | 4 | 5 | 6 | 7 | 8 | 9 | | 11 | | | | BOT |
| 40 | | | | | 5 | | | | | | 11 | | | | TOP |
| 41 | | 2 | | 4 | 5 | 6 | 7 | 8 | 9 | 10 | 11 | 12 | | | BOT |
| 42 | | 2 | | | | | | 8 | 9 | | | | | | TOP BI |
| 43 | 1 | 2 | 3 | | 5 | | 7 | 8 | 9 | 10 | 11 | 12 | | | BOT |
| 44 | | | | | 5 | | | | | | 11 | | | | TOP |
| 45 | 1 | 2 | 3 | 4 | 5 | 6 | | 8 | | 10 | 11 | 12 | | | BOT |
| 46 | | 2 | | | | | | 8 | | | | | | | TOP |
| 47 | 1 | 2 | 3 | 4 | 5 | 6 | 7 | 8 | 9 | | 11 | | | | BOT |
| 48 | | | | | 5 | 6 | | | | | 11 | | | | TOP BI |

Fig. 2

| | 1 | 2 | 3 | 4 | 5 | 6 | 7 | 8 | 9 | 10 | 11 | 12 | | | |
|---|---|---|---|---|---|---|---|---|---|---|---|---|---|---|---|
| STEPS | | | | | FRAMES | | | | | | | | | | |
| 1 | | 2 | | 4 | 5 | 6 | 7 | 8 | 9 | 10 | 11 | 12 | | | BOT |
| 2 | | 2 | | | | | | 8 | | | | | | | TOP |
| 3 | 1 | 2 | 3 | | 5 | | 7 | 8 | 9 | 10 | 11 | 12 | | | BOT |
| 4 | | | | | 5 | | | | | | 11 | | | | TOP |
| 5 | 1 | 2 | 3 | 4 | 5 | 6 | | 8 | | 10 | 11 | 12 | | | BOT |
| 6 | 1 | 2 | 3 | | | | | 8 | | | | | | | TOP BI |
| 7 | 1 | 2 | 3 | 4 | 5 | 6 | 7 | 8 | 9 | | 11 | | | | BOT |
| 8 | | | | | 5 | | | | | | 11 | | | | TOP |
| 9 | | 2 | | 4 | 5 | 6 | 7 | 8 | 9 | 10 | 11 | 12 | | | BOT |
| 10 | | 2 | | | | | | 8 | | | | | | | TOP |
| 11 | 1 | 2 | 3 | | 5 | | 7 | 8 | 9 | 10 | 11 | 12 | | | BOT |
| 12 | | | | | 5 | | | | | 10 | 11 | 12 | | | TOP BI |
| 13 | 1 | 2 | 3 | 4 | 5 | 6 | | 8 | | 10 | 11 | 12 | | | BOT |
| 14 | | 2 | | | | | | 8 | | | | | | | TOP |
| 15 | 1 | 2 | 3 | 4 | 5 | 6 | 7 | 8 | 9 | | 11 | | | | BOT |
| 16 | | | | | 5 | | | | | | 11 | | | | TOP |
| 17 | | 2 | | 4 | 5 | 6 | 7 | 8 | 9 | 10 | 11 | 12 | | | BOT |
| 18 | | 2 | | | | | 7 | 8 | 9 | | | | | | TOP BI |
| 19 | 1 | 2 | 3 | | 5 | | 7 | 8 | 9 | 10 | 11 | 12 | | | BOT |
| 20 | | | | | 5 | | | | | | 11 | | | | TOP |
| 21 | 1 | 2 | 3 | 4 | 5 | 6 | | 8 | | 10 | 11 | 12 | | | BOT |
| 22 | | 2 | | | | | | 8 | | | | | | | TOP |
| 23 | 1 | 2 | 3 | 4 | 5 | 6 | 7 | 8 | 9 | | 11 | | | | BOT |
| 24 | | | | 4 | 5 | 6 | | | | | 11 | | | | TOP BI |

Fig. 6

HIGH PERMEABILITY, MULTI-LAYER WOVEN MEMBERS EMPLOYING MACHINE DIRECTION BINDER YARNS FOR USE IN PAPERMAKING MACHINE

FIELD OF INVENTION

This invention relates generally to improved, high permeability, multi-layer woven members for use in papermaking machines. In the preferred embodiments, the members are employed to convey fibrous webs through the dryer section of a papermaking machine. Most preferably the woven members of this invention are carriers, or base fabrics for a resinous, embossing layer cast thereon. In accordance with this invention the woven members employ a unique woven structure to achieve numerous benefits.

BACKGROUND OF THE INVENTION

Multi-layer fabrics are widely known in the papermaking art and are employed in various sections of a papermaking machine. One such multi-layer structure, which preferably is employed in the dryer section of a papermaking machine, is disclosed in Gaisser U.S. Pat. No. 5,114,777. The woven fabric disclosed in Gaisser is a two layer structure including pairs of vertically stacked warp yarns that are spaced apart from each other in the cross-machine-direction and are held together in their vertically stacked relationship by a plurality of single weft yarns spaced along the machine direction of the fabric. Although this fabric has been used commercially in dryer fabrics, improvements are desired in material costs, stability, seam strength and drainage or water extraction from fibrous webs without retention of excess water in the fabric.

Other multilayer papermaking fabrics employing warp binder yarns and being usable in various sections of a papermaking machine are disclosed in the prior art. For example, Stelljes, Jr. et al. U.S. Pat. No. 5,840,411 discloses a number of different embodiments of two-layer fabrics wherein each layer includes interwoven weft and warp yarns. These layers are connected together by tie warns, which can be separate warp or weft yarns that are independent from the weave pattern in either layer, or warp or weft yarns that also contribute to the weave pattern in one or both of the layers. Also, these tie yarns are described as possibly being of a reduced diameter to minimize blockage of open areas through the fabric. The structures disclosed in this patent employ two distinct layers, each including interwoven single warp and single weft yarns and are not directed to structures employing a plurality of paired warp yarns in the weave construction.

U.S. Pat. No. 4,995,529, issued to Kositzke, discloses a multilayer film including upper and lower, self-sustaining layers, each including interwoven machine direction and cross machine direction yarns. Although this patent discloses the vertical aligning of machine direction and cross machine direction yarns in each layer, it does not relate in any way to structures including paired machine direction yarns in either layer.

U.S. Pat. No. 5,454,405, issued to Hawes, discloses a triple layer papermaking fabric including top and bottom weft yarn layers interconnected by top warp yarns that form part of a warp yarn system with underlying warp yarns. The underlying warp yarns are not employed to bind the top and bottom weft yarn layers together. This patent does not disclose a fabric employing paired warp yarns transversely aligned in a single layer.

U.S. Pat. No. 5,219,004, issued to Chiu, discloses multilayer structures employing bottom warp binder yarns. In one disclosed embodiment these bottom warp yarns are included in pairs, with each pair being located in a region underlying the open area between two, single top warp yarns. These disclosed fabrics are described as being forming fabrics usable in the wet end of a papermaking machine and are neither designed nor intended to be employed as a dryer fabric in a dryer section of a papermaking a machine. In particular, the fabrics disclosed in the Chiu '004 patent have a substantially lower open area than is desired or needed in dryer fabrics of papermaking machines. In fact, the top ply or layer of the Chiu structure preferably has twice as many shute yarns as in the bottom side, with the shute yarns on the bottom side underlying the open area between the shute yarns in the top ply. This impedes the flow of water through the fabric, and would be undesirable for use in dryer fabrics; particularly through air dryer (TAD) fabrics.

Other types of fabrics employing partner yarns are disclosed in Fitzka et al. U.S. Pat. No. 5,092,372. In these fabrics extra partner yarns are added to a top ply to vary the number of fiber supporting points in the fabric.

Other multi-layer fabrics for use in papermaking machines are disclosed in U.S. Pat. No. 4,314,589 (Buchanan et al.); U.S. Pat. No. 4,501,303 (Osterberg); U.S. Pat. No. 4,705,601 (Chiu); U.S. Pat. No. 4,729,412 (Bugge); U.S. Pat. No. 4,832,090 (Krenkel et al.); U.S. Pat. No. 4,945,952 (Vohringer); U.S. Pat. No. 5,054,525 (Vohringer); U.S. Pat. No. 5,151,316 (Durkin et al.) and U.S. Pat. No. 5,152,326 (Vohringer).

Applicants believe that a need exists for improved, high permeability, multi-layer woven members in papermaking machines; preferably in dryer fabrics, and more particularly in through air dryer (TAD) fabrics, which have excellent seam strength, excellent stability, high drainage and lower water retention properties than prior art dryer fabric structures and that are capable of supporting, or receiving a cast, resinous, embossing layer employing less resinous material than prior art structures. It is to such woven members and composite dryer fabrics employing same that the present invention is directed.

SUMMARY OF THE INVENTION

The above and other objects of this invention are achieved in a multi-layer woven fabric, which, when flat woven, includes a top layer with a self-sustaining weave construction including top warp yarns extending in the machine direction of fabric movement through a section of a papermaking machine interwoven with top weft or shute yarns extending in the cross-machine-direction of a papermaking machine, most preferably but not necessarily in a plain weave pattern for engaging and/or supporting a fibrous web in a papermaking machine. A bottom layer includes bottom pairs of warp yarns extending in the machine direction of fabric movement through a section of a papermaking machine, and bottom weft, or shute yarns extending in a transverse, or cross-machine-direction substantially normal to said machine direction.

Most preferably, the fabrics of this invention are formed in a flat weaving process, resulting in the warp yarns being disposed in the machine direction of fabric movement through a section of a papermaking machine and the weft yarns being disposed transversely to the warp yarns, i.e., in the cross-machine-direction of the papermaking machine. Although it may be difficult to form the fabrics of this invention in an endless weaving process, if such a process is employed than the weft yarns will be disposed in the machine direction of fabric movement through a section of a papermaking machine and the warp yarns will be disposed transversely to the weft yarns, i.e., in the cross-machine-direction of the papermaking machine. In accordance with the broadest aspects of this invention the fabrics may be formed by either a flat weaving process or an endless weaving process; although the flat weaving process is preferred.

Reference throughout this application, including the claims, to fabrics having yarns being in the "machine direction" refers to the direction of such yarns on a papermaking machine; not on a loom employed to manufacture the fabrics. Similarly, reference throughout this application to fabrics having yarns being in the "cross-machine-direction" refers to the direction of such yarns on a papermaking machine; not on a loom employed to manufacture the fabrics.

For ease of discussion, throughout the remainder of this application flat woven fabrics of this invention will be described, wherein the first and second layers each include warp yarns extending in the machine direction. However, as stated above, in endless woven fabrics of this invention weft yarns will extend in the machine direction.

In preferred embodiments of the invention the bottom warp yarns are paired together to form a plurality of spaced-apart pairs of contiguous warp yarns. The top warp yarns preferably are single warp yarns that are spaced apart in the cross-machine direction a sufficient distance to provide a desired projected open area through the top, paper side layer; preferably, but not limited to at least 25% for permitting the unimpeded passage of air therethrough when the fabric is employed in the dryer section of a papermaking machine.

The bottom pairs of warp yarns are spaced-apart in the cross-machine-direction from adjacent pairs of warp yarns so that each pair substantially vertically underlies a single top warp yarn, and the plurality of bottom weft yarns are spaced-apart in the machine direction so that each bottom weft yarn substantially vertically underlies a top weft yarn; the number of bottom pairs of warp yarns corresponding to the number of individual top warp yarns and the number of bottom weft yarns corresponding to the number of top weft yarns. The bottom warp and weft yarns form a bottom, wear side layer that engages vacuum boxes, drive rolls, and the like. This bottom layer, like the top layer, preferably has a projected open area of at least 25%.

The warp yarns in each pair of warp yarns preferably contact each other along a tangent line, but in some cases may be slightly spaced apart due to slight movement occurring during the weaving operation, or in use of the fabric. However, in all cases the space between adjacent pairs of warp yarns is substantially larger than any spacing that might exist between the yarns in each pair.

At least one warp yarn in at least some of the bottom pairs of warp yarns constitute binder warp yarns that interweave the bottom weft yarns with one another and with the weft yarns in the top layer. In a preferred embodiment of the invention each warp yarn in each respective bottom pair of warp yarns interweaves either with the same or with a different top weft yarn of the top layer; most preferably with a different top weft yarn of said top layer. However, it is within the scope of this invention to employ only one of the bottom warp yarns in all or some of the bottom pairs of warp yarns as a binder yarn to engage a top weft yarn of the top layer. In this latter embodiment, the binder yarn in each pair of bottom warp yarns can have a smaller diameter than its paired warp yarn, which does not move up to the top layer to provide a binding function. This results in less obstruction of the open area than would be the case if the binder yarn were of the same diameter as its paired bottom warp yarn.

Unlike prior art structures, neither the bottom weft yarns nor the bottom pairs of warp yarns excessively block the open areas provided in the top layer since they are in substantial vertical alignment with the top weft yarns and top warp yarns, respectively. This unobstructed condition exists except in the very limited regions in which bottom warp yarns function as binder yarns to interweave with top weft yarns in the upper layer, with each bottom warp binder yarn being closely adjacent to its overlying top warp yarn.

Reference throughout this application to "substantially" or "substantial" in describing the vertical alignment or vertical arrangement of the weft yarns in one layer with the weft yarns in the other layer, and the vertical alignment or vertical arrangement of a single or pair of warp yarns in one layer with a pair of warp yarns in the other layer, includes a relationship wherein the weft and warp yarns in one layer are in precise vertical alignment with the weft and warp yarns in the other layer, respectively, as well as an arrangement wherein a weft yarn and a single warp yarn or pair of warp yarns in one layer at least partially overlie (or partially underlie) a weft yarn and a pair of warp yarns in the other layer, respectively. For example, when a single warp yarn in one layer is in precise vertical alignment with a pair of warp yarns in the other layer the central axis of the single warp yarn is in generally vertical alignment with the line of contact, or contiguous line or very narrow region between the warp yarns in the pair of warp yarns. However, a single warp yarn, or optionally a pair of warp yarns in one layer is "substantially" in vertical alignment with a pair of warp yarns in the other layer even if it is offset in a lateral direction to only partially overlap with the pair of warp yarns in the other layer. However, there does need to be sufficient overlap between the warp yarns in the respective layers to maintain the two layers separated when such layers are bound together by warp binder yarns.

Thus, unlike prior art constructions employing precisely vertically aligned, single warp yarns in opposed first and second layers, it is much easier to maintain the desired substantial vertical alignment in the fabrics of this invention, wherein the warp yarns in at least one layer are disposed in pairs.

Similarly, when a single weft yarn in one layer is in precise vertical alignment with a weft yarn in the other layer the central axes of the respective weft yarns are in general vertical alignment. However, a weft yarn in one layer is in substantial vertical alignment with a weft yarn in the other layer even if the axes are laterally offset; provided that there is some overlap of these weft yarns.

In view of the substantially vertically stacked relationship of the top and bottom weft yarns, on the one hand, and each top warp yarn with a respective pair of bottom warp yarns, on the other hand, vertical, unimpeded passages are provided through each open fabric area bound by a pair of spaced-apart adjacent top warp yarns and spaced-apart adjacent top weft yarns and underlying adjacent pairs of warp yarns and spaced-apart adjacent bottom weft yarns.

In other words, these latter open areas, which are essentially quadrilateral in plan view, are not obstructed in a vertical direction by either the bottom weft yarns, which are stacked substantially vertically beneath the top weft yarns, or by the pairs of bottom warp yarns, which are stacked substantially vertically beneath the top warp yarns, except where a bottom warp yarn functions as a binder yarn by interweaving with a top weft yarn to bind the top woven layer and the bottom weft yarns together into a self-sustaining, multi-layer fabric construction. However, even where bottom warp binder yarns interweave with a weft yarn in the top, layer, they do so in a region closely adjacent to, or contiguous with their substantially vertically overlying top warp yarn so as not to excessively block the open area vertically through the member. Moreover, the number of these binder locations is minimal so as not to adversely affect fluid flow through the woven fabric.

Preferably, the projected open area in both the paper side layer and the wear side layer is at least 25%; more preferably at least 30%; still more preferably close to 35%. In fact, in the most preferred embodiments of this invention, when the papermaking fabric is a through air dryer (TAD) fabric, the projected open area in the paper side layer, prior to including a cast, resinous embossing layer thereon, is at least 35 percent, more preferably in excess of 40% and in some constructions in excess of 50%. The desired projected open area in said paper side layer and wear side layer is provided by the selection of yarn diameters and yarn spacing, consistent with obtaining other required properties in the fabric, e.g., stability and stiffness.

In accordance with the most preferred embodiments of this invention the projected open area in one of the layers is different than the projected open area in the other layer. This results from the spaced apart warp yarns in one layer having a different diameter, or transverse dimension parallel to the plane of the fabric than the transverse dimension of substantially vertically aligned pairs of warp yarns in the other layer. In the preferred embodiment of this invention the paper side layer includes spaced-apart single warp yarns substantially vertically overlying paired warp yarns in the wear side layer; thereby resulting in a fabric having a higher projected open area in the paper side layer than in the wear side layer. In fact, the open area in the vertical direction through the fabric is generally funnel-shaped; being larger in the paper side layer and smaller in the wear side layer. This difference in projected open area may provide advantages in controlling air flow through the fabric. In addition, providing a lower projected open area in one of the layers may permit the use of less resin in casting an embossing layer on the fabric to achieve a desired porosity through the fabric. In other words, since the projected open area in one of the layers is less than the projected open area in the other layer, less resin will be required in the lower projected open area region to achieve a desired air permeability, as compared to the amount of resin required to achieve that same level of air permeability in a region of the fabric having a higher projected open area prior to casting. The use of less resin results in a desirable reduction in material costs.

In a preferred form of this invention, the above described, multilayer members of this invention are carrier fabrics for receiving a resinous embossing layer cast thereon, such as a layer of the type disclosed in FIGS. 2 and 3 of the aforementioned Gaisser '777 patent. The subject matter of the Gaisser '777 patent is fully incorporated herein by reference, it being understood that the specific resinous embossing layer is a structure well-known to those skilled in the art and does not constitute a separate and independent invention of the present applicants. In fact, representative constructions employing a cast, resinous framework on a woven carrier fabric are disclosed in U.S. Pat. No. 4,514,345, issued to Johnson et al.; U.S. Pat. No. 4,528,239, issued to Trokhan; U.S. Pat. No. 4,529,480, issued to Trokhan and U.S. Pat. No. 4,637,859, issued to Trokan. The subject matter in these latter four patents is fully incorporated herein by reference.

BRIEF DESCRIPTION OF THE DRAWINGS

FIG. 2 is a weave diagram showing one weave repeat of a fabric in accordance with one embodiment of this invention that is particularly well-suited for use in the dryer section of a papermaking machine, with the unnumbered areas in the matrix illustrating a "down position" in the loom of the represented warp yarns at the time that a shute or weft yarn is inserted into the fabric;

FIG. 6 is a weave diagram showing one weave repeat of another embodiment of a fabric in accordance with this invention that is particularly well-suited for use in the dryer section of a papermaking machine, with the unnumbered areas in the matrix illustrating a "down position" in the loom of the represented warp yarns at the time that a shute or weft yarn is inserted into the fabric;

DESCRIPTION OF THE BEST MODES OF THE INVENTION

Figure 1:
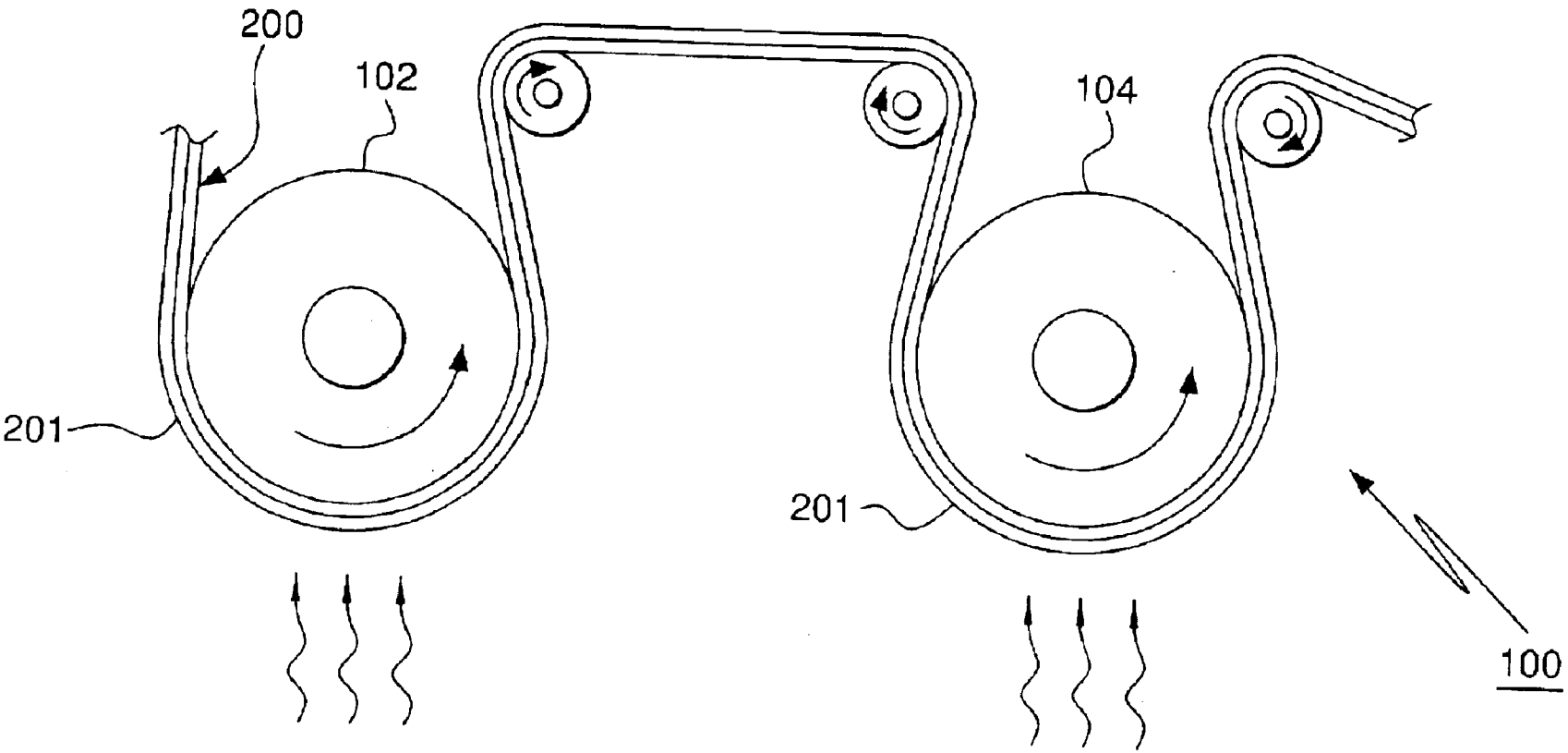
FIG. 1 is a schematic view showing a through air dryer section of a papermaking machine in which fabrics in accordance with this invention can be employed.

Referring to FIG. 1, a dryer section of a papermaking machine, and in particular a TAD dryer section, is schematically illustrated at 100. This section includes a unique fabric 200 in accordance with a first embodiment of this invention, which is trained about a pair of open mesh cylinders 102, 104. A hood (not illustrated) overlies the cylinders for directing hot air through both a paper web 201 and the dryer fabric 200 carrying the paper web thereon, in the direction illustrated by arrows 106. The hot air passing through the dryer fabric 200 moves into the rolls 102, 104 and then is re-circulated into and through the hood section, in a well known manner. Although a schematic view of a TAD section is shown it should be understood that this is for illustrative purposes only and that the dryer section employing the fabrics of this invention can be of any desired type, including, but not limited to a dryer section of the type schematically disclosed in the aforementioned Gaisser '777 patent, the subject matter of which already has been incorporated herein by reference in its entirety.

Moreover, the fabric 200 may have applications in sections of a papermaking machine other than a dryer section, such as the forming section or press section. In a press section the woven member is a base fabric of a press felt having a fibrous batt that preferably is needled therein.

Figure 3:
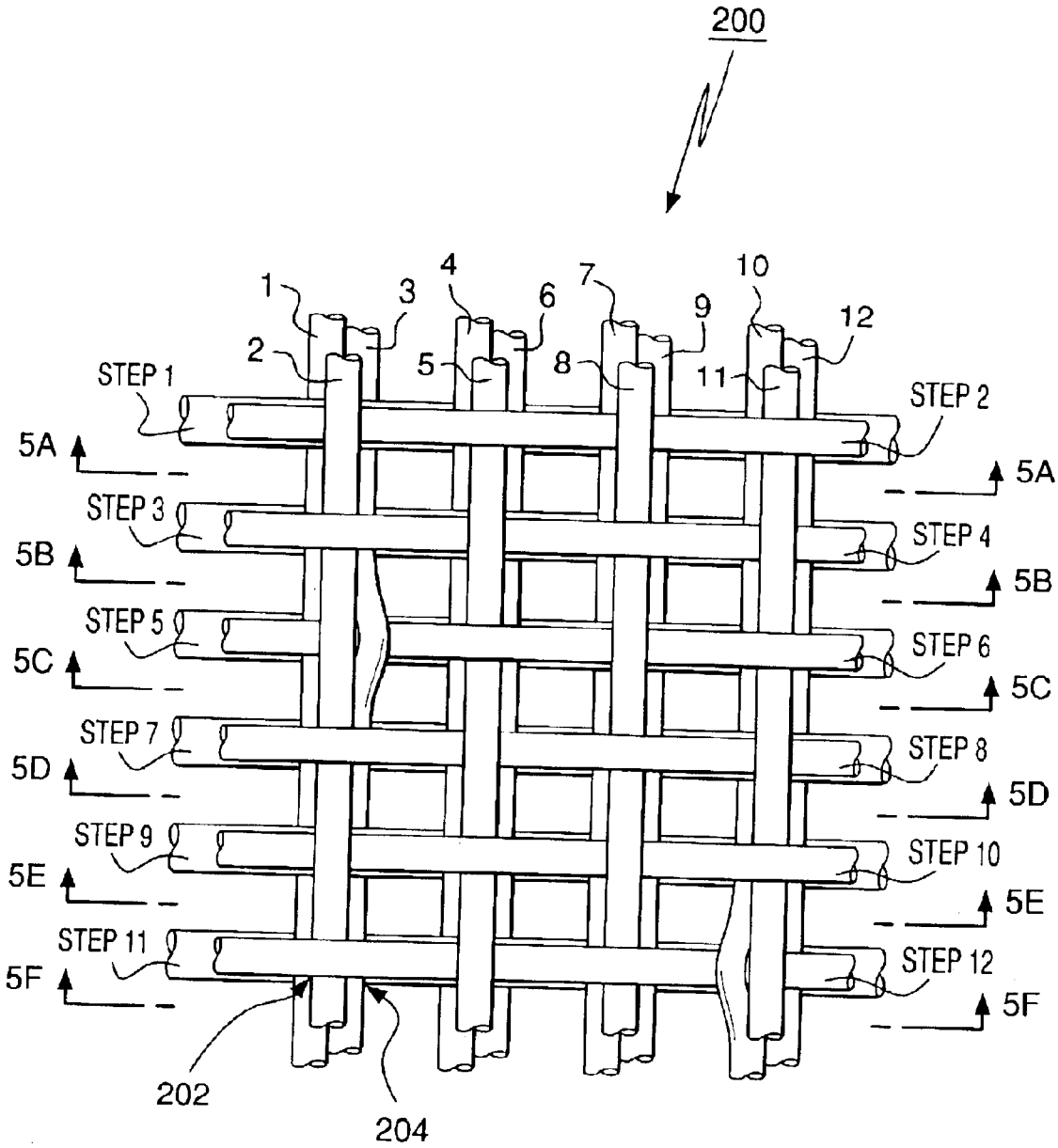
FIG. 3 is a partial plan view of the fabric employing the weave pattern of FIG. 2, showing the arrangement employing the first twelve (12) shute yarns, which are referred to in FIG. 2 as STEPS 1–12.
Figure 4:
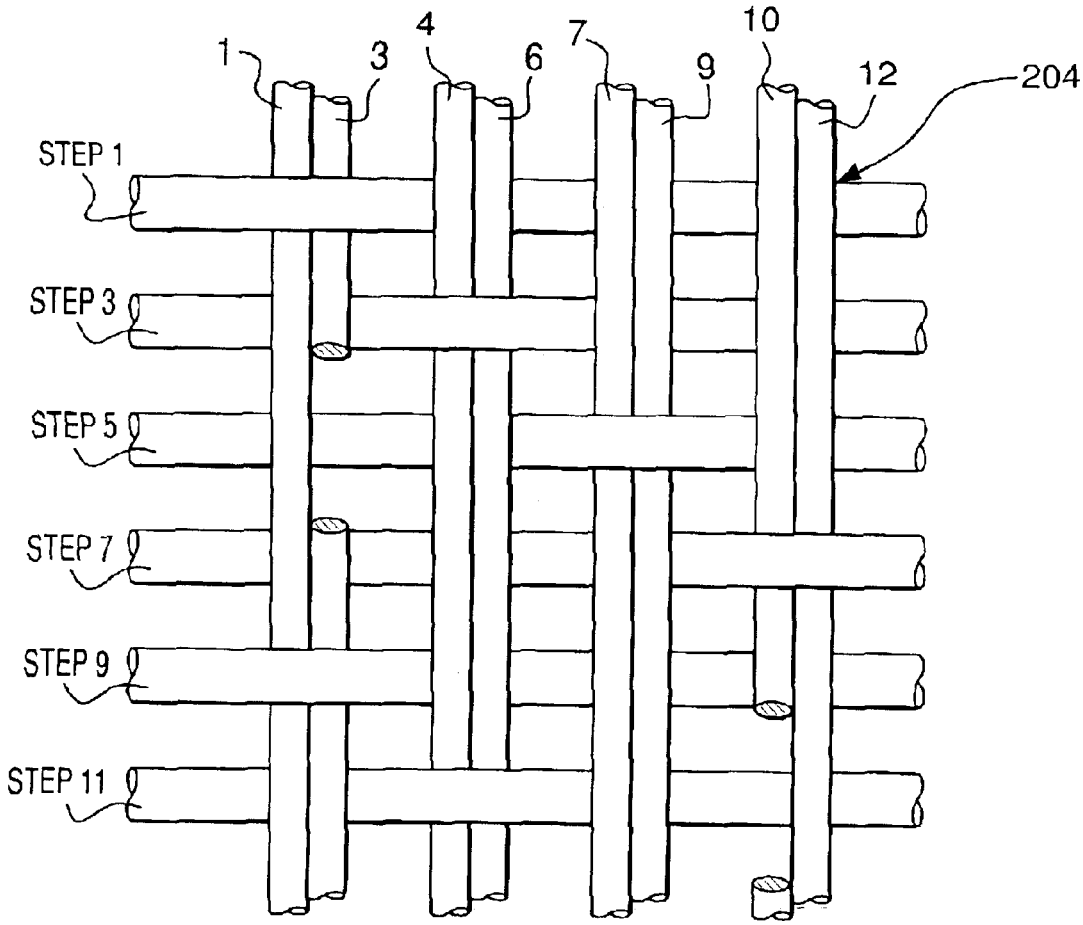
FIG. 4 is a horizontal section view taken between the top and bottom layers of FIG. 3 and looking down on the bottom layer; showing in detail the manner in which the bottom pairs of warp binder yarns weave with the bottom shute yarns and also move up to bind with weft yarns of the top layer.
Figure 5A:
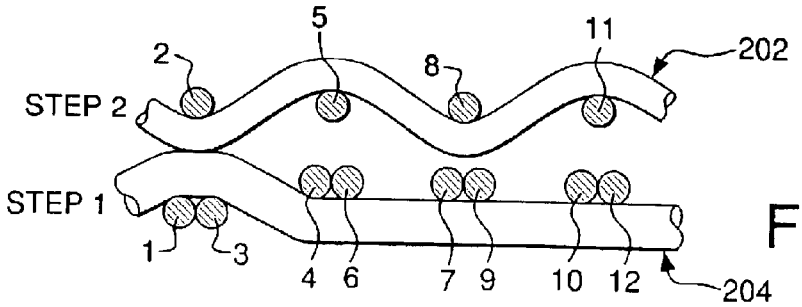
FIGS. 5A–5F are vertical sectional views along lines 5A—5A through 5F—5F, respectively, of FIG. 3.
Figure 5B:
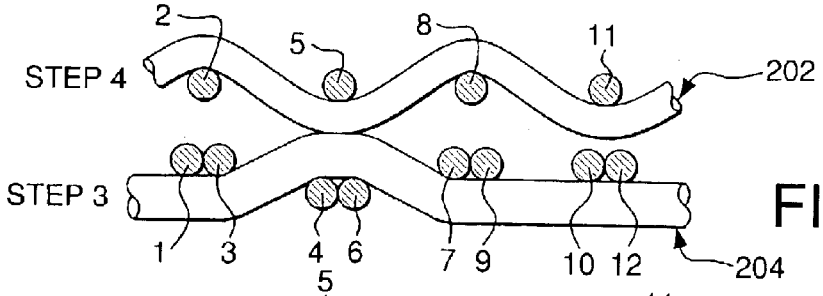
Figure 5C:
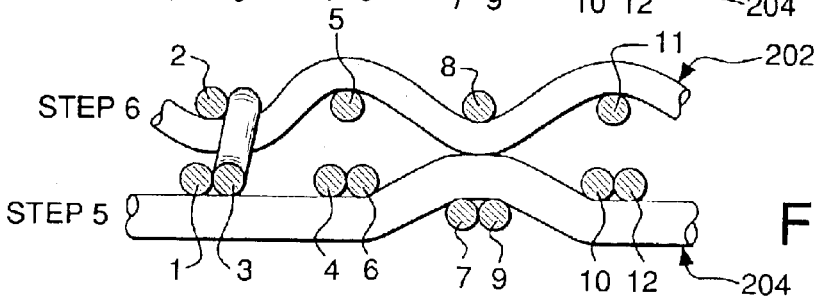
Figure 5D:
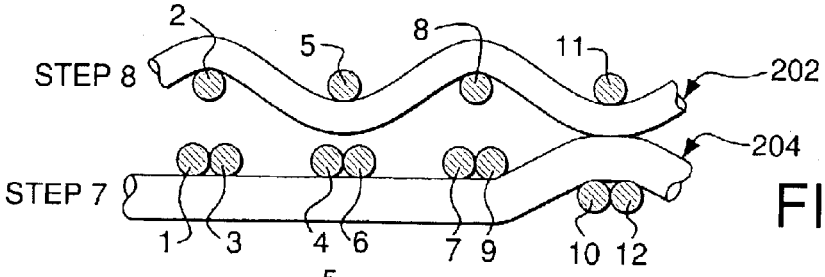
Figure 5E:
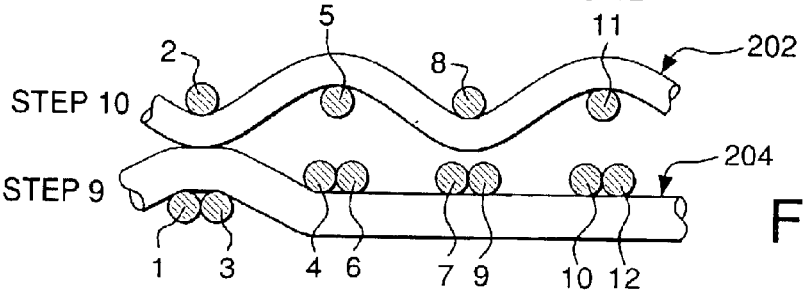
Figure 5F:
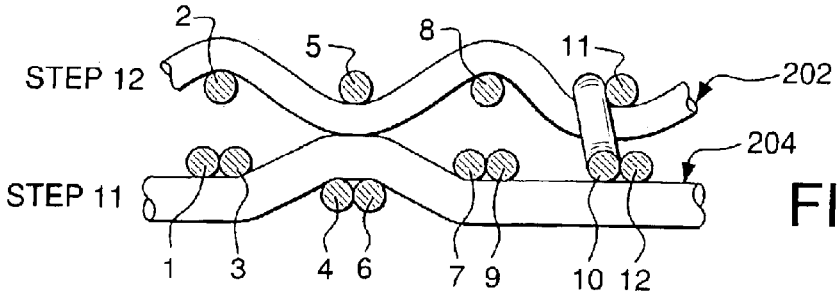

The woven fabric 200 in accordance with a first embodiment of this invention has the repeating weave pattern shown in FIG. 2 and partially illustrated in FIGS. 3–5. This fabric 200 is a multi-layer, woven member having top and bottom layers 202 and 204, respectively, as illustrated most clearly in FIGS. 3–5.

Referring to FIG. 2, a repeating weave pattern of the fabric 200 in accordance with this invention is illustrated. In this illustrated embodiment of the invention the fabric is a 12 shed, 48 step repeat. All of the warp yarns come off of the loom at the same level, and are then manipulated relative to the weft yarns to form the self-staining top layer 202 including top warp yarns numbered 2, 5, 8 and 11 within each repeat and top weft yarns, which are the even-numbered steps 2, 4, 6, 8 . . . 48. In addition, the loom is manipulated to form bottom pairs of warp binder yarns, e.g., 1–3, 4–6, 7–9 and 10–12 within each repeat, and these binder pairs are woven together with the odd-numbered bottom wefts, or steps, 1, 3, 5, 7, 9, 11 . . . 43 to form the bottom layer 204. In the preferred embodiment the top layer 202 is the paper side layer that contacts a paper web being formed on a papermaking machine and the bottom layer 204 is the wear side layer for contacting vacuum boxes, driving rolls, and the like.

As illustrated in FIG. 2, the blank squares or blocks located at the intersections of designated warp and weft yarns, that is, the squares or blocks that do not include a number in them, are regions in which the warp yarns in the loom are in a "down" position when the corresponding weft yarn (step) is directed across the fabric in a transverse direction. Thus, in the location where bottom weft yarn no. 1 is directed across the fabric (referenced as Step 1), warp yarns 1 and 3 are down; resulting in the bottom weft yarn passing over warp yarns 1 and 3 and under warp yarns 2 and 4 through 12 (See FIG. 5). This actually results in warp yarns 1 and 3 being formed into a first bottom pair of warp binder yarns in the 12 shed repeat of fabric 12. In a similar manner, bottom weft yarn no. 3 passes over only warp yarns 4 and 6 in the repeat (FIG. 5); thereby resulting in warp yarns 4 and 6 being formed into a second bottom pair of warp binder yarns in the 12 shed repeat of fabric 12. In a similar manner, bottom weft yarn no. 5 passes over only warp yarns 7 and 9 in the repeat; thereby resulting in warp yarns 7 and 9 being formed into a third bottom pair of warp binder yarns in the 12 shed repeat of fabric 12. And bottom weft yarn no. 7 passes over only warp yarns 10 and 12 in the repeat; thereby resulting in warp yarns 10 and 12 being formed into a fourth bottom pair of warp binder yarns in the 12 shed repeat of fabric 12.

Still referring to FIG. 2, the right column of the weave pattern specifies whether the specified step, or weft yarn, is a bottom weft yarn forming part of the bottom layer 204, a top weft yarn forming part of the top layer 202 and also which top weft yarns are engaged by a bottom warp yarn to constitute a binder yarn of the top layer. As illustrated, every third top weft yarn, i.e., 6, 12, 18, 24, 30, 36, 42 and 48 is a binder weft yarn in the top layer, i.e., a yarn that is engaged by one of the bottom warp yarns in a respective bottom pair of warp yarns. Specifically, within the 12 shed repeat, bottom warp yarn 3 of binder pair 1-3 binds to top weft yarn 6; bottom warp yarn 10 of binder pair 10–12 binds to top weft yarn 12; bottom warp yarn 7 of binder pair 7–9 binds to top weft yarn 18; bottom warp yarn 4 of binder pair 4–6 binds to top weft yarn 24; bottom warp yarn 1 of binder pair 1–3 binds to top weft yarn 30; bottom warp yarn 12 of binder pair 10–12 binds to top weft yarn 36; bottom warp yarn 9 of binder pair 7–9 binds to top weft yarn 42 and bottom warp 6 of binder pair 4–6 binds to top weft yarn 48.

From the above discussion, it should be apparent that within the 12 shed repeat the sequence in which one binder yarn from each pair of bottom binder yarns binds to a top weft yarn of the top layer 14 is as follows: one warp binder yarn (i.e., 3) from the first warp binder yarn pair 1 and 3; one warp binder yarn (i.e., 10) from the fourth warp binder yarn pair 10 and 12; one warp binder yarn (i.e., 7) from the third warp binder yarn pair 7 and 9 and one warp binder yarn (i.e., 4) from the second warp binder yarn pair 4 and 6. Thereafter, the binder sequence is the other warp binder yarn 1 of the first warp binder yarn pair 1 and 3; the other warp binder yarn 12 of the fourth warp binder yarn pair 10 and 12; the other warp binder yarn 9 from the third warp binder yarn pair 7 and 9 and the other warp binder yarn 6 from the second warp binder yarn pair 4 and 6. By staggering the sequence of the binder pairs (i.e., pair 1, pair 4, pair 3 and pair 2) binding to every third top weft yarn of the top layer 14, the formation of an undesired twill pattern in the formed and dried sheet is avoided.

As shown in FIG. 4, four (4) consecutive bottom wefts form one repeat of the bottom weft layer. That is bottom steps (or wefts) 1, 3, 5 and 7 form one repeat of the bottom wefts. A second, adjacent repeat of the bottom wefts is formed by bottom steps (or wefts) 9, 11, 13 and 15 (e.g., bottom weft 9 forms the identical weave pattern as bottom weft 1; bottom weft 11 forms the identical weave pattern as bottom weft 3; bottom weft 13 forms the identical weave pattern as bottom weft 5 and bottom weft 15 forms the identical pattern as bottom weft 7). This same repeat is provided by bottom steps (or wefts) 17, 19, 21 and 23; 25, 27, 29 and 31; 33, 35, 37 and 39 and 41, 43, 45 and 47. However, in accordance with the broadest aspects of this invention the bottom weft yarns can be woven in different repeat patterns. The important relationship is that the number of bottom weft yarns be the same as the number of top weft yarns and that these bottom and top weft yarns be in a substantially vertically stacked relationship.

Turning to the top, or paper side layer 202, it is a self-sustaining weave construction including top warp yarns 2, 5, 8 and 11 within each repeat, interwoven with even numbered steps, or top weft yarns 2, 4, 6, 8, 10, 12 . . . 48 in a plain weave pattern. The plain weave is highly desirable in this invention because it provides significant crimp in the top warp yarns, which provides for enhanced seam strength. However, in accordance with the broadest aspect of this invention other weave patterns can be employed in the top layer 202. As noted above, the important relationship is that the number of top weft yarns be the same as the number of bottom weft yarns and that these top and bottom weft yarns be in a substantially vertical aligned, or stacked relationship.

Referring to FIGS. 3 and 5, it should be noted that top weft yarn 2 (step 2) is directed under top warp yarns 2 and 8 and over the remaining 10 yarns in the 12 shed repeat; top weft yarn 4 is directed under top warp yarns 5 and 11 and over the remaining 10 yarns in the 12 shed repeat; top weft yarn 6 is directed under top warp yarns 2 and 8, and in addition is directed under bottom warp yarn 3 of the bottom pair of warp yarns 1 and 3 to bind the top woven layer 202 to the bottom weft yarns 1, 3, 5, 7 . . . 47 of the bottom layer 204. The top weave pattern then continues with top weft yarn 8 passing under top warp yarns 5 and 11 and over the remaining 10 yarns in the 12 shed repeat; top weft yarn 10 passing under top warp yarns 2 and 8 and over the remaining 10 yarns in the 12 shed repeat and top weft yarn 12 passing under top warp yarns 5 and 11, and in addition being directed under bottom warp yarn 10 of the bottom pair of warp yarns 10 and 12 to again bind the top woven layer 202 to the bottom weft yarns 1, 3, 5, 7 . . . 47 of the bottom layer 204. This pattern is then repeated with the remaining top weft yarns, with every third top weft passing under one of the warp binder yarns of a bottom binder pair, as discussed in detail above.

Figure 10:
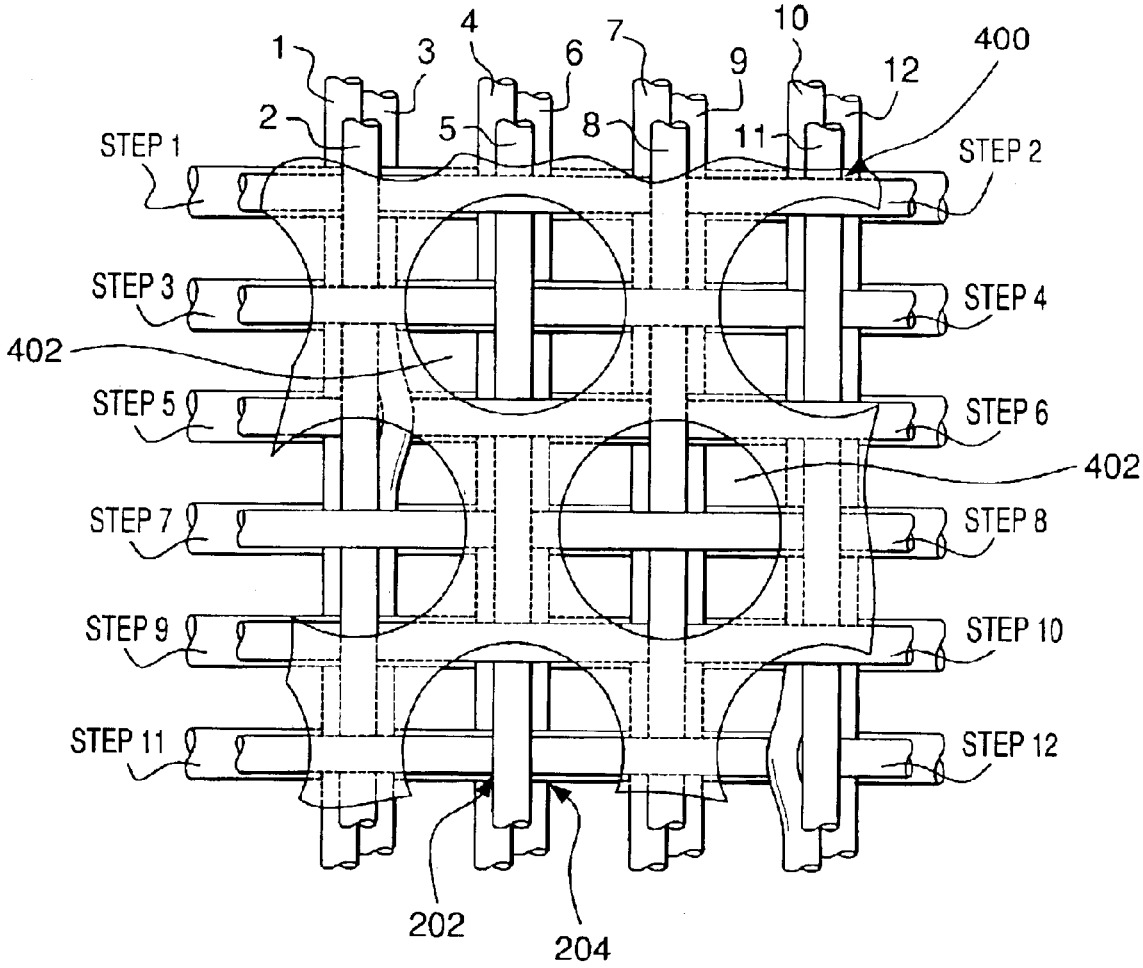
FIG. 10 is a plan view schematically illustrating the multilayer fabric of FIGS. 2–5 as a carrier fabric for a resinous, embossed top layer.

The diameter of the top warp yarns 2, 5, 8 and 11 and top weft yarns 2, 4, 6, 8, etc. can be varied to achieve desired fabric properties, e.g., projected open area. In representative embodiments of the invention these latter yarns are in the range of 0.16–0.22 millimeters. Moreover, the top warp and weft yarns can be of the same or different diameters and cross-sectional shapes, e.g., ovate, round, square, rectangular, etc., again depending on the properties desired in the fabric. In the embodiment illustrated in FIGS. 3–5, the diameter of both the top warp and top weft yarns are the same; preferably approximately 0.16 millimeters, and are monofilament yarns made of polyphenylene sulfide, which is a high temperature-resistant, UV transparent resin. However, it is within the scope of this invention to utilize other resins in the yarns of this invention, such as, but not limited to polyketones (e.g., PEEK), polyethylene napthalate (i.e. PEN) and polyester; the particular material employed to form the yarns utilized in the fabrics of this invention not constituting a limitation on the broadest aspects of this invention. However, most preferably the material employed in the fabrics of this invention has high temperature, hydrolysis and dry heat resistance. UV transparent yarns are highly desirable in structures including a cast, UV curable resinous layer thereon (e.g., a resinous layer 400 as illustrated in FIG. 10), to permit the UV curing of the resinous layer to the woven fabric. This is well-known in the art, and therefore no further explanation is provided herein.

Referring to FIGS. 3–5, and in particular to FIG. 4, the fabric 200 also includes a plurality of bottom weft or shute yarns, represented by odd numbered steps 1, 3, 5, 7, 9, 11 . . . 47; each of which substantially vertically underlies a corresponding top weft or shute yarn 2, 4, 6, 8, 10, 12 . . . 48. In the embodiment illustrated in FIG. 3, the bottom weft yarns 1, 3, 5, etc. have a greater diameter then the top weft yarns 2, 4, 6, etc. to provide enhanced stability to the fabric. In the illustrated embodiment the diameter of the bottom weft yarns is approximately 0.22 millimeters, whereas, as noted above, the diameter of the top weft yarns is approximately 0.16 millimeters. The substantial vertical alignment, or substantial vertical stacking of the top weft yarns 2, 4, 6, etc. with the bottom weft yarns 1, 3, 5, etc is best illustrated in FIG. 3, and prevents the bottom weft yarns from blocking the open areas through the top layer 202.

Still referring to FIGS. 3–5, the fabric 200 also includes four (4) bottom pairs of warp binder yarns 1–3, 4–6, 7–9 and 10–12 within each repeat. These pairs of binder yarns bind the bottom weft yarns 1, 3, 5, etc together and also bind these bottom weft yarns to the top layer 202, and in particular to every third weft yarn in the top layer, e.g., step 6, step 12, step 18, etc.

As can be seen best in FIGS. 3 and 5, the number of bottom pairs of warp binder yarns is the same as the number of top warp yarns, e.g., in the illustrated repeat there are four (4) top warp yarns 2, 5, 8 and 11 and four (4) pairs of bottom warp binder yarns 1–3, 4–6, 7–9 and 10–12; each bottom warp binder yarn pair being substantially vertically aligned under a corresponding top warp yarn, e.g., binder pair 1–3 substantially vertically underlies top warp yarn 2; binder pair 4–6 substantially vertically underlies top warp 5; binder pair 7–9 substantially vertically underlies top warp 8 and binder pair 10–12 substantially vertically underlies top warp 11. This pattern repeats throughout the structure of the fabric 200. Thus, as can be seen best in FIG. 3, the bottom pairs of warp binder yarns do not obstruct the passages vertically through the top layer 202. In fact, even at the locations at which a warp binder yarn e.g., 3, moves up to bind to a top weft yarn e.g., 6, it is closely adjacent the contiguous top warp yarn e.g., 2 so as not to block the open passages through the top layer 202.

As stated above, in the illustrated embodiment, each of the top warp yarns in the top layer 202 has a diameter of 0.16 millimeters and each of the warp binder yarns in the bottom pairs of warp yarns is 0.16 millimeters in diameter, although the diameters of the top warp yarns and bottom weft binder yarns can be varied within the scope of this invention to achieve the desired properties. Thus, in the illustrated embodiment, each of the binder warp yarns within each bottom pair is in a side-by-side relationship; having an effective transverse dimension parallel to the plane of the fabric of approximately 0.32 millimeters (2×0.16). Therefore, as viewed in plan view through the fabric (FIG. 3), segments of the bottom pairs of warp binder yarns 1–3, 4–6, 7–9 and 10–12 are observed as they extend transversely beyond the substantially vertically overlying top warp yarns 2, 5, 8 and 11, respectively.

From the above discussion, it should be apparent that in the illustrated embodiment the projected open area in the bottom wear side layer, which is the layer including the paired warp binder yarns, is less than the projected open area in the paper side layer. This results from the fact that the effective transverse dimension of both the lower weft yarns and the paired lower warp yarns is greater than the transverse dimension of the respective overlying top weft yarns and single top warp yarns. In fact, this relationship provides generally funnel-shaped passages extending through the thickness of the fabric, with the projected open area in the top, paper side layer being greater than the projected open area in the bottom, wear side layer.

It should be noted that the multilayer fabric 200 depicted in FIG. 2 has a top layer 202 with a plain weave pattern and a four shed bottom weave pattern, considering each pair of bottom binder yarns as a single unit, i.e., each bottom weft yarn 1, 3, 5, 7, etc. in each repeat, passes over one bottom warp binder pair and under three bottom warp binder pairs. As noted above, the remaining four warp yarns in the 12 shed repeat are top warp yarns 2, 5, 8 and 11.

The particular weave pattern in the fabric 200 can be varied in accordance with the broadest aspects of this invention. For example, and not by way of limitation, the fabric can include a plain, or other weave over a five shed repeat (e.g., 15–30 sheds in each repeat) or a plain, or other weave over a six shed repeat (e.g., 24–48 sheds in each repeat).

Figure 7:
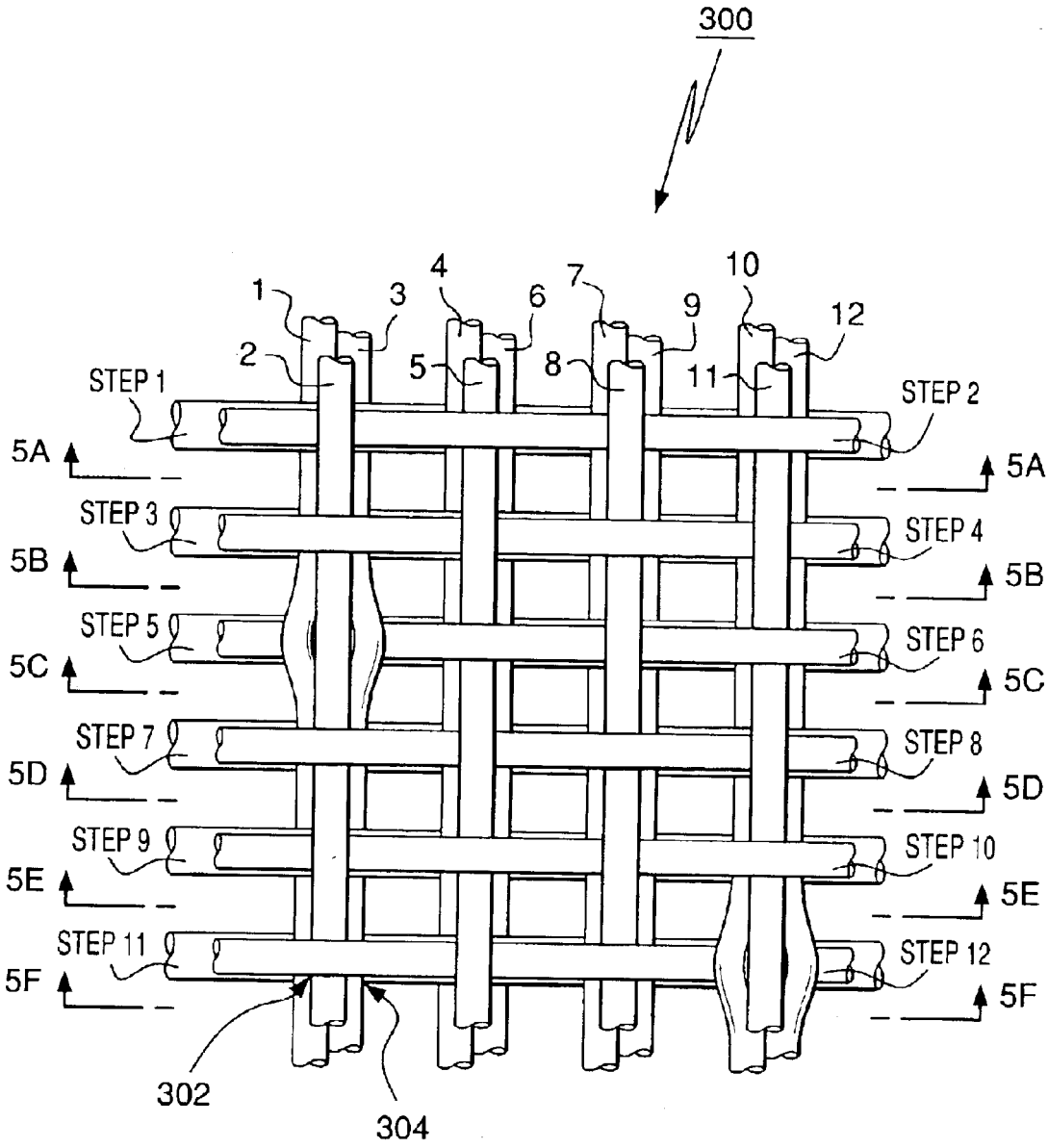
FIG. 7 is a partial plan view of the fabric employing the weave pattern of FIG. 6, showing the arrangement employing the first twelve (12) shute yarns, which are referred to in FIG. 6 as STEPS 1–12.
Figure 8:
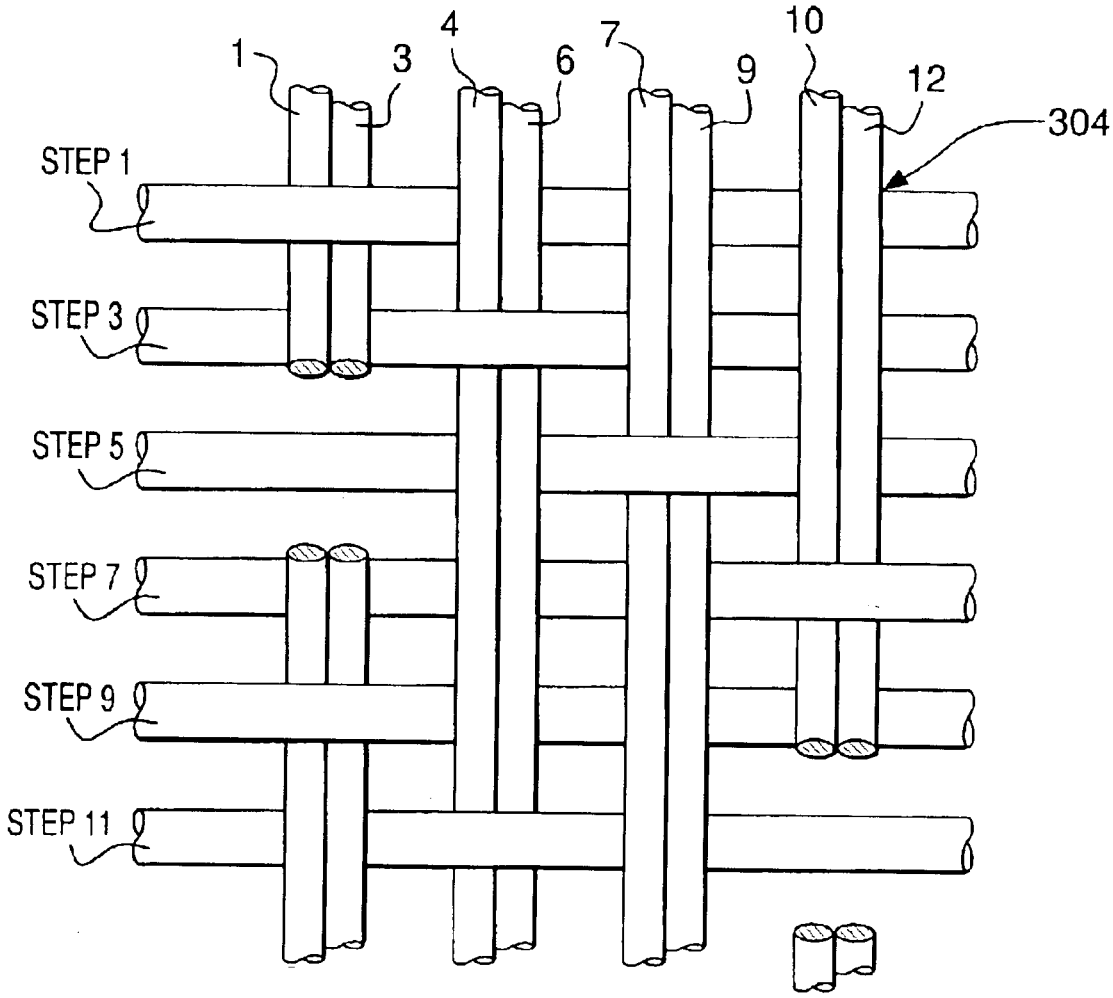
FIG. 8 is a horizontal sectional view taken between the top and bottom layers of FIG. 7 and looking down on the bottom layer; showing in detail the manner in which the bottom pairs of warp binder yarns weave with the bottom shute yarns and also move up to bind with weft yarns of the top layer.
Figure 9A:
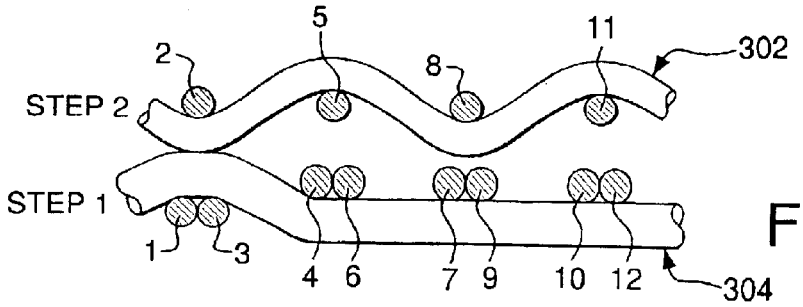
FIGS. 9A–9F are vertical sectional views along lines 9A—9A through 9F—9F, respectively, of FIG. 7.
Figure 9B:
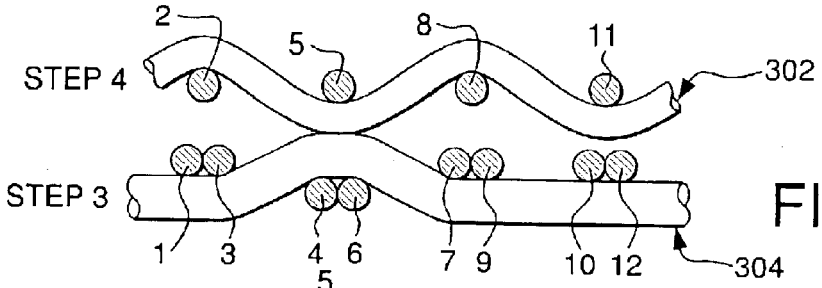
Figure 9C:
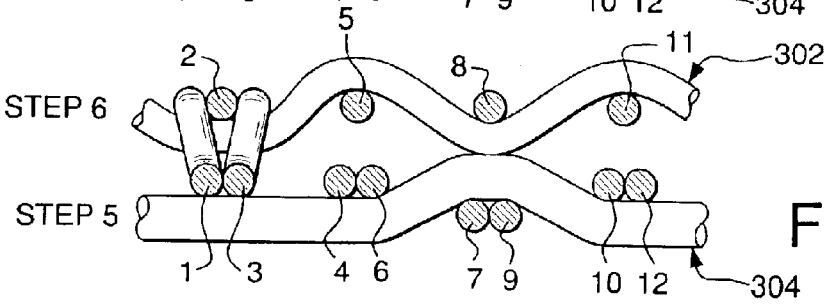
Figure 9D:
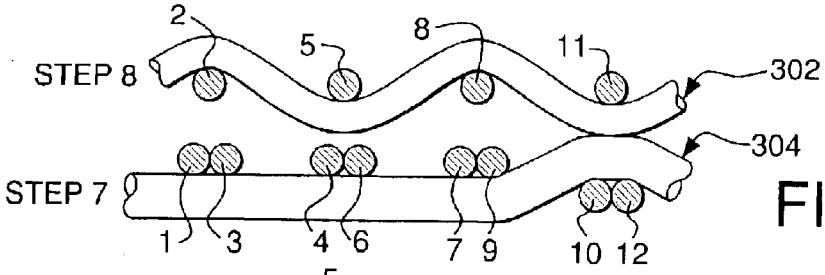
Figure 9E:
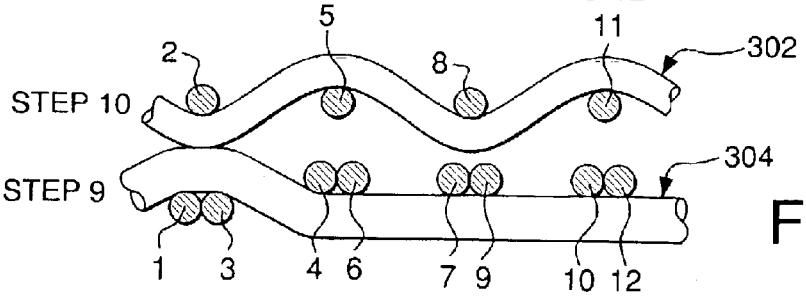
Figure 9F:
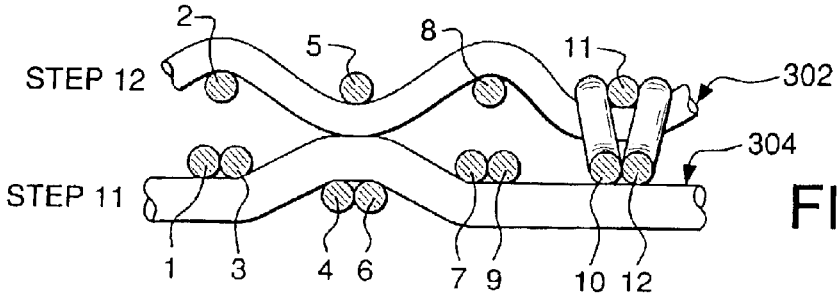

Referring to FIG. 6, a weave pattern of an additional embodiment of a fabric in accordance with this invention is shown. In this embodiment of the invention the fabric, which is designated 300 in FIGS. 7–9, is a 12 shed, 24 step repeat. This fabric 300 is identical to the fabric 200, with one exception. In the dryer fabric 300, both warp yarns of each bottom binder pair bind to the same top weft yarn, thereby providing a 24 step repeat rather than a 48 step repeat. To further explain, in the fabric 300 each third top weft yarn, i.e., step 6, step 12, step 18 and step 24 is bond to the bottom weft yarns 1, 3, 5, 7 . . . 23 by both bottom warp yarns of a specific bottom binder yarn pair. In particular, the bottom pair of warp binder yarns 1,3 forming the first binder yarn pair both bind to top weft yarn 6; the bottom pair of warp binder yarns 10, 12 forming the fourth binder yarn pair both bind to the top weft yarn 12; the bottom pair of warp binder yarns 7, 9 forming the third binder yarn pair both bind to the top weft yarn 18 and the bottom pair of warp binder yarns 4,6 forming the second binder yarn pair both bind to the top weft yarn 24.

In the formation of fabric 300, like fabric 200, all of the warp yarns come off of the loom at the same level, and are then manipulated relative to the weft yarns to form the self-staining top layer 302 including top warp yarns numbered 2, 5, 8 and 11 within each repeat and top weft yarns, which are the even-numbered steps 2, 4, 6, 8 . . . 24. In addition the loom is manipulated to form bottom pairs of warp binder yarns, e.g., 1–3, 4–6, 7–9 and 10–12 within each repeat, which are woven together with the odd-numbered bottom wefts, or steps 1, 3, 5, 7, 9, 11 . . . 23 to form a bottom layer 304, in the same manner as the bottom layer 204 is formed in the fabric 200.

As illustrated in FIG. 6, the blank squares or blocks located at the intersections of designated warp and weft yarns, that is, the squares or blocks that do not include a number in them, are regions in which the indicated warp yarns in the loom are in a "down" position when the corresponding weft yarn (step) is directed across the fabric in a transverse direction. Except for the fact that both bottom warp yarns of each binder yarn pair pass over the same top weft yarn, the 12 shed, 24 step repeat is identical to the 12 shed, first 24 step segment of the weave pattern illustrated in FIG. 2. Thus, in the location where bottom weft yarn no. 1 is directed across the fabric (referenced as Step 1), warp yarns 1 and 3 are down; resulting in the bottom weft yarn passing over warp yarns 1 and 3 and under warp yarns 2 and 4 through 12 (See FIG. 9). This actually results in warp yarns 1 and 3 being formed into a first bottom pair of warp binder yarns in the 12 shed repeat of fabric 12. In a similar manner, bottom weft yarn no. 3 passes over only warp yarns 4 and 6 in the repeat (FIG. 9); thereby resulting in warp yarns 4 and 6 being formed into a second bottom pair of warp binder yarns in the 12 shed repeat of fabric 12. In a similar manner, bottom weft yarn no. 5 passes over only warp yarns 7 and 9 in the repeat; thereby resulting in warp yarns 7 and 9 being formed into a third bottom pair of warp binder yarns in the 12 shed repeat of fabric 12. And bottom weft yarn no. 7 passes over only warp yarns 10 and 12 in the repeat; thereby resulting in warp yarns 10 and 12 being formed into a fourth bottom pair of warp binder yarns in the 12 shed repeat of fabric 12.

Still referring to FIG. 6, the right column of the weave pattern specifies whether the specific step, or weft yarn, is a bottom weft yarn forming part of the bottom layer 304, a top weft yarn forming part of the top layer 302 and also which top weft yarns are engaged by pairs of bottom warp yarns to constitute a binder yarn in the top layer 302. As illustrated, every third top weft yarn e.g., 6, 12, 18 and 24 is a top binder weft yarn in the top layer, i.e., a yarn that is engaged by the two bottom warp yarns of a respective bottom pair of warp yarns. Specifically, within the 12 shed repeat, the bottom pair of warp yarns 1–3 binds to top weft yarn 6; the bottom pair of warp yarns 10–12 binds to top weft yarn 12; the bottom pair of warp yarns 7–9 binds to top weft yarn 18 and the bottom pair of warp yarns 4–6 binds to top weft yarn 24.

From the above discussion, it should be apparent that within the 12 shed repeat the sequence in which each pair of bottom binder yarns binds to a top weft yarn of the top layer 302 is as follows: first binder yarn pair; fourth binder yarn pair; third binder yarn pair and second binder yarn pair. By staggering the sequence of the binder pairs (i.e., pair 1, pair 4, pair 3 and pair 2) binding to every third top weft yarn of the top layer 302, the formation of an undesired twill pattern in the formed and dried sheet is avoided.

As shown in FIG. 8, four (4) consecutive bottom wefts form one repeat of the bottom weft layer. That is bottom steps (or wefts) 1, 3, 5 and 7 form one repeat of the bottom wefts. A second, adjacent repeat of the bottom wefts is formed by bottom steps (or wefts) 9, 11, 13 and 15 (e.g., bottom weft 9 forms the identical weave pattern as bottom weft 1; bottom weft 11 forms the identical weave pattern as bottom weft 3; bottom weft 13 forms the identical weave pattern as bottom weft 5 and bottom weft 15 forms the identical pattern as bottom weft 7). This same repeat also is provided by bottom steps (or wefts) 17, 19, 21 and 23.

Turning to the top layer 302, it is of a self-sustaining weave construction including top warp yarns 2, 5, 8 and 11 within each repeat, interwoven with even numbered steps, or top weft yarns 2, 4, 6, 8, 10, 12 . . . 24 in a plain weave pattern. As in the fabric 200, the plain weave construction is highly desirable as it provides significant crimp in the top warp yarns, which enhances the seam strength of the fabric. However, other weaves can be employed; the important feature being that the number of top weft yarns is equal to the number of bottom weft yarns and that these top and bottom weft yarns are in a substantially vertically aligned, or stacked arrangement.

Referring to FIGS. 7 and 9, it should be noted that top weft yarn 2 is directed under top warp yarns 2 and 8 and over the remaining 10 yarns in the 12 shed repeat; top weft yarn 4 is directed under top warp yarns 5 and 11 and over the remaining 10 yarns in the 12 shed repeat; top weft yarn 6 is directed under top warp yarns 2 and 8, and in addition is directed under the first pair of bottom warp yarns 1–3 to bind the top woven layer 302 to the bottom weft yarns 1, 3, 5, 7 . . . 23 of the bottom layer 304 The top weave pattern then continues with top weft yarn 8 passing under top warp yarns 5 and 11 and over the remaining 10 yarns in the 12 shed repeat; top weft yarn 10 passing under top warp yarns 2 and 8 and over the remaining 10 yarns in the 12 shed repeat and top weft yarn 12 passing under top warp yarns 5 and 11, and in addition being directed under the fourth bottom pair of warp yarns 10–12 to again bind the top woven layer 302 to the bottom weft yarns 1, 3, 5, 7 . . . 23 of the bottom layer 304. This pattern is then repeated with the remaining top weft yarns, i.e., every third top weft passing under a bottom pair of warp binder yarns, as discussed in detail above.

As is the case with fabric 200, in fabric 300 the diameter of the top warp yarns 2, 5, 8 and 11 and top weft yarns 2, 4, 6, 8, etc. can be varied to achieve the desired properties in the fabric. In representative embodiments of the invention these latter yarns have a diameter in the range of 0.16–0.22 millimeters. Moreover, the top warp and weft yarns can be of the same or different diameters or cross-sectional shapes, e.g., ovate, round, square, rectangular, etc., again depending upon the properties desired in the fabric. In the embodiment illustrated in FIGS. 7–9, the diameter of both the top warp and top weft yarns is approximately 0.16 millimeters, and are monofilament yarns that can be made of the same resins employed to make the yarns of the fabric 200. As noted above, the particular material employed to form the yarns utilized in the fabrics of this invention is not a limitation on the broadest aspects of the invention.

Referring to FIGS. 7–9, and in particular FIG. 8, the dryer fabric 300 also includes a plurality of bottom weft or shute yarns, represented by odd numbered steps 1, 3, 5, 7, 9, 11 . . . 23; each of which substantially vertically underlies a corresponding top weft or shute yarn 2, 4, 6, 8, 10, 12 . . . 24. In the embodiment illustrated in FIG. 7, the bottom weft yarns 1, 3, 5, etc. are of a greater diameter then the top weft yarns 2, 4, 6, etc. to provide enhanced wear resistance and stability to the fabric. In the illustrated embodiment, the diameter of the bottom weft yarns is approximately 0.22 millimeters, whereas, as noted above, the diameter of the top weft yarns is approximately 0.16 millimeters. The substantial vertical alignment, or substantial vertical stacking of the top weft yarns 2, 4, 6, etc. with the bottom weft yarns 1, 3, 5, etc is best illustrated in FIG. 7, and prevents the bottom weft yarns from blocking the open areas through the top layer 302.

Still referring to FIGS. 7–9, the dryer fabric 300 also includes four (4) bottom pairs of warp binder yarns 1–3, 4–6, 7–9 and 10–12 within each repeat. These pairs of binder warp yarns bind the bottom weft yarns 1, 3, 5, 7 . . . 23 together and also bind these bottom weft yarns to the top layer 302, and in particular to every third weft yarn in the top layer, e.g., step 6, step 12, step 18 and step 24. As with the fabric 200, the particular weave pattern employed in fabric 300 does not constitute a limitation on the broadest aspects of this invention.

As can be seen best in FIGS. 7 and 9, the number of bottom pairs of warp binder yarns is the same as the number of top warp yarns. In the illustrated repeat there are four (4) top warp yarns 2, 5, 8 and 11 and four (4) pairs of bottom warp binder yarns 1–3, 4–6, 7–9 and 10–12; each bottom warp binder yarn pair being substantially vertically aligned under a corresponding top warp yarn. In particular, binder pair 1–3 substantially vertically underlies top warp yarn 2; binder pair 4–6 substantially vertically underlies top warp 5; binder pair 7–9 substantially vertically underlies top warp 8 and binder pair 10–12 substantially vertically underlies top warp 11. This pattern repeats throughout the structure of the fabric 300. Thus, as can be seen best in FIG. 7, the bottom pairs of warp binder yarns do not obstruct the passages vertically through the top layer 302. In fact, even at the locations at which the pairs of bottom warp binder yarns e.g.,1–3 move up to bind to a top weft yarn e.g., 6, the yarns of the pair are closely adjacent the contiguous top warp yarn e.g., 2 so as not to block the open passages through the top layer 302.

As stated above, in the illustrated embodiment, each of the top warp yarns in the top layer 302 has a diameter of 0.16 millimeters and each of the warp binder yarns in the bottom pair has a diameter of 0.16 millimeters, although the diameters of the top warp yarns and binder yarns can be varied within the scope of this invention. Thus, in the illustrated embodiment, each of the binder warp yarns within each bottom pair are in a side-by-side relationship; having an effective transverse dimension parallel to the plane of the fabric of approximately 0.32 millimeters (2×0.16). Therefore, as viewed in plan view through the fabric 300 (FIG. 7), segments of the bottom pairs of warp binder yarns 1–3, 4–6, 7–9 and 10–12 are observable as they extend transversely beyond the substantially vertically overlying top warp yarns 2, 5, 8 and 11, respectively.

From the above discussion, it should be apparent that in the illustrated embodiment of the fabric 300 the projected open area in the bottom wear side layer, which is the layer including the paired warp binder yarns, is less than the projected open area in the paper side layer. This results from the fact that the effective transverse dimension of both the lower weft yarns and the paired lower warp yarns is greater than the transverse dimension of the respective overlying top weft yarns and single top warp yarns. In fact, this relationship provides generally funnel-shaped passages extending through the thickness of the fabric, with the projected open area in the top, paper side layer 302 being greater than the projected open area in the bottom, wear side layer 304.

It should be noted that the multilayer fabric 300 depicted in the weave pattern of FIG. 6 has a top layer 302 with a plain weave pattern and a four shed bottom weave pattern, considering each pair of bottom binder yarns as a single unit, i.e., each bottom weft yarn 1, 3, 5, 7 . . . 23, in each repeat, passes over one bottom warp binder pair and under three bottom warp binder pairs. As noted above, the remaining four warp yarns in the 12 shed repeat are top warp yarns 2, 5, 8 and 11. However, as noted above, the particular weave pattern does not constitute a limitation on the broadest aspects of this invention.

The fabric 200 is believed to be more preferred than the fabric 300 because each binder yarn in the fabric interweaves with a different top weft yarn within each repeat, thereby maintaining a desired separation between the top and bottom layers and also a desired balance of properties. In the fabric 300 both yarns of each pair interweave with the same top weft yarn, which may tend to pull the top layer down into the bottom layer; thereby adversely affecting the multi-layer effect of the fabric, and accordingly adversely affecting desired properties of the fabric.

In an exemplary embodiment of fabric 200 of this invention the top warp yarns are present in a density of 35 strands per inch, and the bottom pairs of binder warp yarns also are present in a density of 35 pairs per inch. As noted above, each top warp yarn in the fabric 200 of this invention substantially vertically overlies a corresponding pair of bottom warp binder yarns. Both the top and bottom weft yarns are present in a density of 35 strands per inch with each top weft yarn substantially vertically overlying a corresponding bottom weft yarn.

In the exemplary embodiment of fabric 200 of this invention, each of the top and bottom warp yarns and the top weft yarns have a diameter of 0.16 mm. and the bottom weft yarns have a diameter of 0.22 mm. The paired lower warp yarns in this invention provide an effective transverse dimension of 0.32 mm (0.16 mm×2).

The caliper of the above-described fabric 200 of this invention is approximately 0.029 inches, which is significantly less than a prior structure employing single, vertically stacked warp yarns, all having a diameter of 0.22 mm, with the density of the warp yarns in the top and bottom layers both being 35 yarns/inch and with the warp-balancing weft yarns (i.e., weft yarns that are interwoven with the top and bottom warp yarns to maintain the vertical stacked relationship of those warp yarns) having a diameter of 0.28 mm. This lower caliper is achieved without a significant reduction in modulus and also with an acceptable level of air permeability. The lower caliper structure of the fabrics of this invention should result in the retention of less water therein than in the aforementioned prior art structure; thereby minimizing undesired re-wetting of the fibrous web being dried or otherwise carried on the fabric. The lower caliper also should permit the use of less resin in a cast, embossing layer provided thereon; thereby reducing material costs as compared to casting an embossing layer on the higher caliper, prior art structure.

In this exemplary fabric 200 the projected open area in the top, paper side layer 202 is greater than 40%, more preferably greater than 55% and most preferably over 60%, and the projected open area in the bottom, wear side layer 204 is in excess of 35% and more preferably in excess of 38%. In a specific embodiment of the invention the projected open area in the top, paper side layer 202 is 60.8% and the projected open area in the bottom, wear side layer is 39%. The percentages set forth herein ignore the presence of bottom binder yarns moving out of the bottom layer, and also the presence of such binder yarns moving over top weft yarns to provide a binding function.

Numerous modifications can be made in accordance with the broadest aspects of this invention. For example, in both the fabrics 200 and 300, only one warp yarn in all, or in only some (e.g., 50%) of the paired bottom warp yarns can be employed to provide a binding function to a top weft yarn. In such an arrangement the warp yarn providing the binding function can be of a smaller diameter than its paired bottom warp yarn to minimize the blockage of the open area through the fabric in the region in which the binder yarn moves into the top layer to bind with a top weft yarn. The other bottom warp yarn of the paired warp yarn; that is, the bottom warp yarn that does not move up to bind with a top weft yarn, can be of a greater diameter to enhance the wear resistance on the side of the fabric opposite the side that receives and supports a fibrous web thereon.

Also, both bottom warp yarns of only some of the bottom pairs of warp yarns in the fabrics 200 and 300 can be employed to bind the bottom weft yarns to each other and to the top layer. For example, every other bottom pair of warp yarns can be employed to provide a binding function to a top weft yarn. Most preferably, within each repeat of the weave pattern in fabric 200, each of the warp yarns that provides a binding function binds to a different top weft yarn than every other warp yarn that provides a binding function. In the fabric 300, the two yarns in each respective warp binder yarn pair intertwine with the same top weft yarn, which, in each weave repeat, preferably is different from the top weft yarn that intertwines with the binder yarns in every other warp binder yarn pair.

Referring to FIG. 10, the fabric 200 is illustrated as a carrier, or base fabric for a resinous embossing layer 400. Although this composite structure has a lower permeability than the woven structure without the resinous layer, the permeability is still sufficient for drying purposes. The specific decrease of air permeability between the base fabric without the resinous layer and the base fabric with the resinous layer depends on the size, shape, and pattern of holes 402 in the resinous layer. It should be understood that the fabric 300 also can be employed as a carrier, or base fabric for a resinous embossed layer in the same manner as the fabric 200. Moreover, each of the fabrics 200 and 300 may be utilized as a press felt with a fibrous batt needled therein, or if the weave pattern is fine enough, as a forming fabric in the forming section of a papermaking machine.

Without further elaboration, the foregoing will so fully illustrate my invention that others may, by applying current or future knowledge readily adopt the same for use under various conditions of service.

What is claim is:

1. A multilayer woven fabric for use in a papermaking machine, said fabric including:

a top layer having a self-sustaining weave construction including a plurality of top machine direction yarns interwoven with a plurality of top cross-machine-direction yarns, said top machine direction and top cross-machine-direction yarns being spaced-apart a sufficient distance to provided a desired projected open area in said top layer;

a bottom layer including a plurality of pairs of bottom machine direction yarns and a plurality of bottom cross-machine-direction yarns, each machine direction yarn in each of said bottom pairs of machine direction yarns interweaving said bottom cross-machine-direction yarns with one another and with a top cross-machine-direction yarn of the top layer;

said bottom pairs of machine direction yarns corresponding in number to the number of individual top machine direction yarns and being spaced-apart in said cross-machine-direction so that each bottom pair of machine direction yarns substantially vertically underlies an individual top machine direction yarn of the top layer; and said bottom cross-machine-direction yarns corresponding in number to the number of top cross-machine-direction yarns and being spaced-apart in the machine direction so that each bottom cross-machine-direction yarn substantially vertically underlies a top cross-machine-direction yarn of the top layer, said bottom pairs of machine direction yarns and cross-machine-direction yarns being spaced apart to provide a desired projected open area in said bottom layer.

2. The multilayer woven fabric of claim 1, wherein the machine direction yarns in each respective pair of bottom machine direction yarns interweaves with different top cross-machine-direction yarns of said top layer.

3. The multilayer woven fabric of claim 2, wherein the machine direction yarns in all of the pairs of bottom machine direction yarns within each repeat of the weave pattern interweave with different top cross-machine-direction yarns of said top layer.

4. The multilayer woven fabric of claim 1, wherein, within each repeat of the weave pattern, the machine direction yarns in each respective pair of bottom machine direction yarns interweave with the same top cross-machine-direction yarn of said top layer but with a top cross-machine-direction yarn that is different from the top cross-machine-direction yarns with which the machine direction yarns of each of the other pairs of bottom machine direction yarns interweave.

5. The multilayer woven fabric of claim 1, wherein the projected open area in each of said top and bottom layers is at least 25 percent.

6. The multilayer woven fabric of claim 5, wherein the projected open area in said top layer is greater than the projected open area in said bottom layer.

7. The multilayer woven fabric of claim 6, wherein the projected open area in said top layer is at least 30 percent.

8. The multilayer woven fabric of claim 6, wherein the projected open area in said top layer is at least 35 percent.

9. The multilayer woven fabric of claim 6, wherein the projected open area in said top layer is in excess of 40 percent.

10. The multilayer woven fabric of claim 1 in the form of a fabric for transporting a fibrous web through a dryer section of a papermaking machine.

11. The multilayer woven fabric of claim 10, wherein the dryer section is a through air dryer section.

12. The multilayer woven fabric of claim 11, wherein the projected open area in each of said top and bottom layers is at least 25 percent.

13. The multilayer woven fabric of claim 12, wherein the projected open area in said top layer is greater than the projected open area in said bottom layer.

14. The multilayer woven fabric of claim 13, wherein the projected open area in said top layer is at least 30 percent.

15. The multilayer woven fabric of claim 13, wherein the projected open area in said top layer is at least 35 percent.

16. The multilayer woven fabric of claim 13, wherein the projected open area in said top layer is in excess of 40 percent.

17. The multilayer woven fabric of claim 1, wherein said machine direction yarns are warp yarns and said cross-machine-direction yarns are weft yarns.

18. The multilayer woven fabric of claim 1, wherein said machine direction yarns are weft yarns and said cross-machine-direction yarns are warp yarns.

19. A multilayer woven fabric for use in a dryer section of a papermaking machine, said fabric including:

a top layer having a self-sustaining weave construction including a plurality of top machine direction yarns interwoven with a plurality of top cross-machine-direction yarns, said top machine direction and top cross-machine-direction yarns being spaced-apart a sufficient distance to provided a desired projected open area in said top layer;

a bottom layer including a plurality of pairs of bottom machine direction yarns and a plurality of bottom cross-machine-direction yarns, each machine direction yarn in each of said bottom pairs of machine direction yarns interweaving said bottom cross-machine-direction yarns with one another and with a top cross-machine-direction yarn of the top layer;

said bottom pairs of machine direction yarns corresponding in number to the number of individual top machine direction yarns and being spaced-apart in said cross-machine-direction so that each bottom pair of machine direction yarns substantially vertically underlies an individual top machine direction yarn of the top layer;

said bottom cross-machine-direction yarns corresponding in number to the number of top cross-machine-direction yarns and being spaced-apart in the machine direction so that each bottom cross-machine-direction yarn substantially vertically underlies a top cross-machine-direction yarn of the top layer; and a resinous, embossing layer adhered to said fabric and including an upper surface for contacting a fibrous web and transporting said fibrous web through said dryer section.

20. The multilayer woven fabric of claim 19 wherein the projected open area in each of said top and bottom layers, prior to including the resinous embossing layer in the fabric, is at least 25 percent.

21. The multilayer woven fabric of claim 20, wherein said projected open area in said top layer is greater than said projected open area in said bottom layer.

22. The multilayer woven fabric of claim 21, wherein said projected open area in said top layer is at least 30 percent.

23. The multilayer woven fabric of claim 21, wherein said projected open area in said top layer is at least 35 percent.

24. The multilayer woven fabric of claim 21, wherein said projected open area in said top layer is in excess of 40 percent.

25. The multilayer woven fabric of claim 19, wherein the dryer section is a through air dryer section.

26. The multilayer woven fabric of claim 25 wherein the projected open area in each of said top and bottom layers, prior to including the resinous embossing layer in the fabric, is at least 25 percent.

27. The multilayer woven fabric of claim 26, wherein said projected open area in said top layer is greater than said projected open area in said bottom layer.

28. The multilayer woven fabric of claim 27, wherein said projected open area in said top layer is at least 30 percent.

29. The multilayer woven fabric of claim 27, wherein said projected open area in said top layer is at least 35 percent.

30. The multilayer woven fabric of claim 27, wherein said projected open area in said top layer is in excess of 40 percent.

31. The multilayer woven fabric of claim 27, wherein said projected open area in said top layer is in excess of 40 percent.

32. The multilayer woven fabric of claim 19, wherein said machine direction yarns are weft yarns and said cross-machine-direction yarns are warp yarns.

* * * * *